US006224322B1

(12) United States Patent
Calboreanu

(10) Patent No.: US 6,224,322 B1
(45) Date of Patent: May 1, 2001

(54) SEAL ASSEMBLY FOR CENTRIFUGAL PUMPS WITH BARRIER RING

(75) Inventor: Gabriela E. Calboreanu, Longmont, CO (US)

(73) Assignee: A. R. Wilfley & Sons, Inc., Denver, CO (US)

( * ) Notice: Subject to any disclaimer, the term of this patent is extended or adjusted under 35 U.S.C. 154(b) by 0 days.

(21) Appl. No.: 09/192,730

(22) Filed: Nov. 16, 1998

(51) Int. Cl.[7] ..... F04D 29/12

(52) U.S. Cl. ..... 415/34; 415/111; 415/113; 415/171.1; 415/174.3; 415/231; 277/423; 277/425; 277/433; 277/554; 277/555

(58) Field of Search ..... 415/30, 33, 34, 415/111, 113, 171.1, 174.2, 174.3, 231; 277/423, 425, 433, 554, 555

(56) References Cited

U.S. PATENT DOCUMENTS

| | | | | |
|---|---|---|---|---|
| 1,346,926 | | 1/1920 | Wilfley . | |
| 1,556,657 | | 10/1925 | Wilfley . | |
| 1,893,814 | * | 1/1933 | Widin | 277/555 |
| 1,976,532 | | 10/1934 | Wilfley . | |
| 2,049,063 | * | 7/1936 | Hubbard | 277/555 |
| 2,266,175 | * | 12/1941 | Delaval-Crow | 277/555 |
| 2,272,454 | | 2/1942 | Wilfley . | |
| 2,488,465 | * | 11/1949 | Bourne, Jr. | 277/554 |
| 2,608,423 | | 8/1952 | Wilfley . | |
| 2,660,487 | | 11/1953 | Wilfley . | |
| 3,137,237 | | 6/1964 | Zagar et al. . | |
| 3,472,169 | | 10/1969 | Dyke et al. . | |
| 3,515,497 | | 6/1970 | Studebaker et al. . | |
| 3,652,180 | | 3/1972 | Choquette et al. . | |
| 4,133,542 | * | 1/1979 | Janian et al. | 277/555 |
| 4,379,558 | * | 4/1983 | Pippert | 277/554 |
| 4,508,356 | * | 4/1985 | Janian | 277/555 |
| 4,789,166 | * | 12/1988 | Rericha et al. | 277/555 |
| 4,915,579 | | 4/1990 | Whittier et al. . | |
| 5,667,356 | | 9/1997 | Whittier et al. . | |
| 5,791,657 | * | 8/1998 | Cain et al. | 277/554 |
| 5,799,953 | * | 9/1998 | Henderson | 277/554 |

* cited by examiner

*Primary Examiner*—Christopher Verdier
(74) *Attorney, Agent, or Firm*—John E. Reilly

(57) ABSTRACT

In a centrifugal pump, a barrier ring in the form of a dynamic seal member is interposed between relatively rotating, generally circular wall portions which undergo relative axial movement to vary the width of a gap between the wall portions, the seal member having an outer jacket of flexible material and an annular spring member of frustoconical configuration inserted into offset grooves in the jacket, and when the seal member is mounted under compression between the confronting surfaces will follow the relative axial movement between the wall portions to maintain liquid-tight sealing engagement with the wall portions. In a modified form of invention, the seal member includes a pair of helical spring members inserted into grooves in an outer flexible jacket and, when the seal is mounted under compression between confronting surfaces of the wall portions as described will maintain liquid-tight sealing engagement notwithstanding variations in the width of the gap between members.

25 Claims, 6 Drawing Sheets

SEAL ASSEMBLY FOR CENTRIFUGAL PUMPS WITH BARRIER RING

BACKGROUND AND FIELD OF INVENTION

This invention relates to seals and more particularly relates to a novel and improved dynamic seal for pumps of the hydraulic sealing type and which are adaptable for use in pumping acids or slurries.

A. R. Wilfley & Sons, Inc. is the assignee of previously developed seals for centrifugal pumps which obviates the use of a packing gland or mechanical seal bearing directly against a rotating part but is capable of sealing against the leakage of liquid into the seal housing or reservoir when the pump is not in operation and has no hydraulic sealing capability. Conversely, when the pump is in operation, it will hydraulically seal against leakage of liquid from the expeller region into the seal housing or reservoir of the pump. For example, attention is directed to U.S. Pat. No. 5,667,356 to Whittier et al for ACID/SLURRY GOVERNOR ASSEMBLY FOR CENTRIFUGAL PUMPS.

Nevertheless, there is a continuing need for a dynamic seal of simplified construction which is conformable for use both with acids and slurries and which will prevent solids from settling into the cavity under the seal housing when the pump is not in operation, assists the expeller in solids evacuation from the expeller cavity and stationary seal faces, and effectively prevents the leakage of liquid from the expeller region into the seal housing of the pump when the pump is at rest. It is further desirable that the seal member have a variable spring constant according to its intended application and provided with outer sealing surfaces which can be composed of a material chemically compatible with the fluid to be sealed, flexible enough to withstand movement in adjusting to the width of the gap between the surfaces to be sealed and soft enough to form a liquid-tight seal with both confronting surfaces.

Other representative patents are U.S. Pat. No. 1,346,926 to Wilfley, U.S. Pat. No. 1,556,657 to Wilfley, U.S. Pat. No. 1,976,532 to Wilfley, U.S. Pat. No. 2,272,454 to Wilfley, U.S. Pat. No. 2,608,423 to Wilfley, U.S. Pat. No. 2,660,487 to Wilfley, U.S. Pat. No. 3,137,237 to Zagar et al, U.S. Pat. No. 3,472,169 to Dyke et al, U.S. Pat. No. 3,515,497 to Studebaker et al, U.S. Pat. No. 3,652,180 to Choquette et al and U.S. Pat. No. 4,915,579 to Whittier et al.

SUMMARY OF THE INVENTION

It is an object of the present invention to provide for a novel and improved seal which is capable of spanning a gap between relatively rotating members and is self-adjusting to changes in the width of the gap.

It is another object of the present invention to provide for a novel and improved seal member for centrifugal pumps and the like which will prevent leakage of liquid or solids into the seal housing when the pump is not in operation; and specifically wherein the seal member is mounted so as to span the gap between a rotating expeller and seal housing and maintain a liquid-tight seal with confronting surfaces of the expeller and seal housing whereby to prevent solids from settling in the cavity under the seal housing when the pump is shut off, and assist the expeller in solids evacuation from the expeller cavity and stationary seal faces.

It is a further object of the present invention to provide for a novel and improved seal for centrifugal pumps incorporating a unique form of spring element having a profile which determines its spring constant and which can be specific to each pump size in order to compensate for the closing and opening force of the pump.

In accordance with the present invention, a barrier ring in the form of a dynamic seal member is interposed between generally radial wall portions which undergo relative axial movement as well as to vary the width of a gap between the portions, the seal member having an outer jacket of flexible material and an annular spring member inserted in a groove in the jacket wherein mounting of the seal member under compression between confronting surfaces of the relatively rotating portions will maintain liquid-tight sealing engagement with the confronting surfaces notwithstanding variations in the width of the gap. Preferably, the spring member is an endless or annular spring of generally conical configuration inserted in opposed facing grooves in the jacket and wherein the spring extends at an acute angle between the confronting surfaces to maintain sealing engagement with the surfaces notwithstanding variations in the width of the gap. In a modified form of invention, the spring member is an endless helical spring(s) inserted in a circumferentially extending groove(s) in the jacket. Most desirably, in the modified form, a pair of endless helical springs are employed in juxtaposed relation to one another in a pair of grooves in the jacket. A typical application of the barrier rings is to a centrifugal pump of the type having a seal housing in outer spaced surrounding relation to a drive shaft, an impeller and expeller mounted on the drive shaft forwardly of the seal housing with the expeller being operative to resist liquid flow into the seal housing when the drive shaft is rotated at a predetermined rate of speed, the annular barrier seal member being interposed in a gap between the expeller and seal housing, the gap increasing in width in response to axial movement of the seal housing away from the expeller when the drive shaft is not being rotated, the seal member including an outer jacket of a flexible material, an annular spring of generally conical configuration inserted in a groove in the jacket, the seal member extending at an acute angle between confronting surfaces of the expeller and the housing with opposite edges of the jacket maintaining sealing engagement with the expeller and housing notwithstanding variations in the width of the gap.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
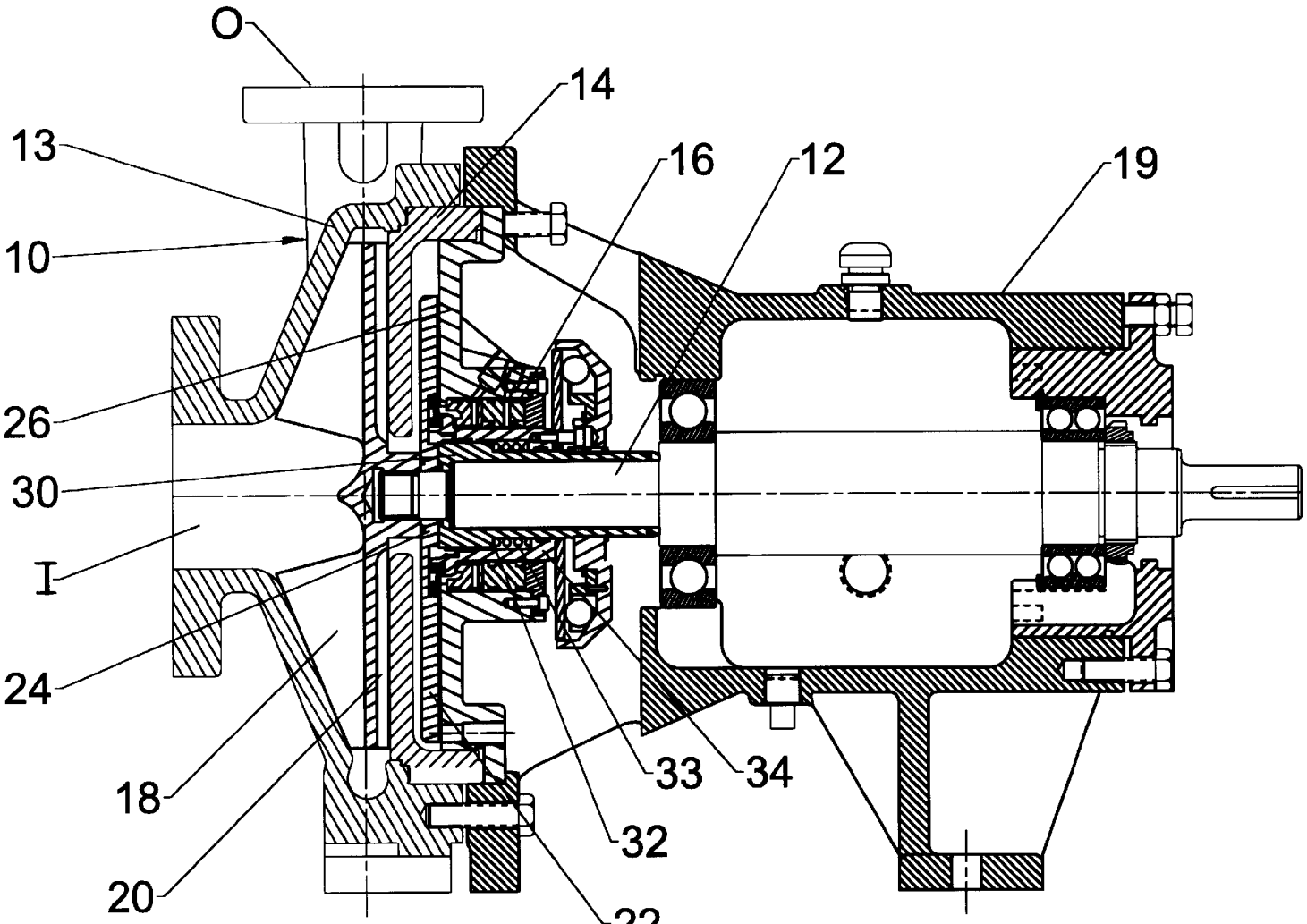
FIG. 1 is a longitudinal sectional view of a centrifugal pump with a preferred form of barrier ring illustrated when the pump is in operation.

Referring in detail to FIGS. 1 to 5 of the drawings, there is shown by way of illustrative example in FIG. 1 a centrifugal pump 10 having a central drive shaft 12 and outer pump casing 13 including a rear pump bearing frame 19, and a case plate 14 is disposed in surrounding relation to a seal housing 16. An inlet I at the forward end of the casing permits introduction of a liquid into an impeller 18 mounted for rotation on the drive shaft 12, the liquid being discharged radially and outwardly through an outlet O in the pump casing 13. The impeller 18 is mounted on the forward end of the drive shaft 12 and carries with it a primary expeller 20, and a secondary expeller 22 includes a hub portion 24 mounted for rotation with the drive shaft 12, the expeller 22 having radially extending vanes, not shown, but which in accordance with conventional practice extend rearwardly in facing relation to a radial wall 26 projecting radially and outwardly from the seal housing 16 and connected to the casing 13. The expeller 22 is axially spaced between the radial wall of the case plate 14 and radial wall 26 to establish fluid channels in communication with one another around the outer peripheral end of the expeller 22 and in communication with the primary expeller region 20.

An elongated hub 30 rotates with the drive shaft 12 and is provided with an external shoulder 32 to facilitate mounting of a return spring 33 between the shoulder 32 and inner radial edge of an actuator sleeve 34. The spring 33 is mounted under compression to normally urge the actuator sleeve 34 in a rearward direction, the sleeve 34 also functioning as the inner wall of the seal housing 16.

Figure 2:
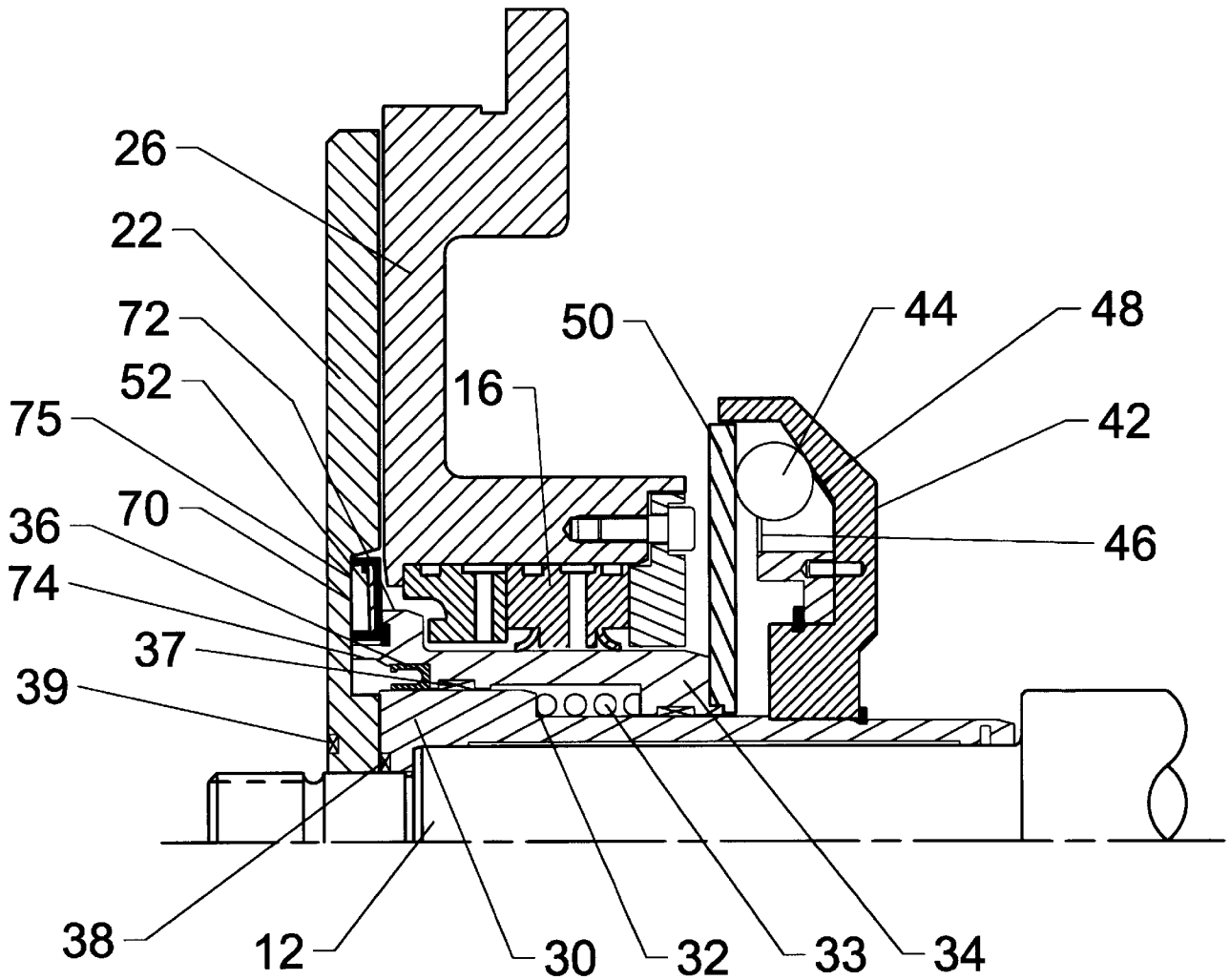
FIG. 2 is an enlarged sectional view of a preferred form of barrier ring installed in a centrifugal pump in accordance with the present invention, the pump being illustrated in the operating position.
Figure 3:
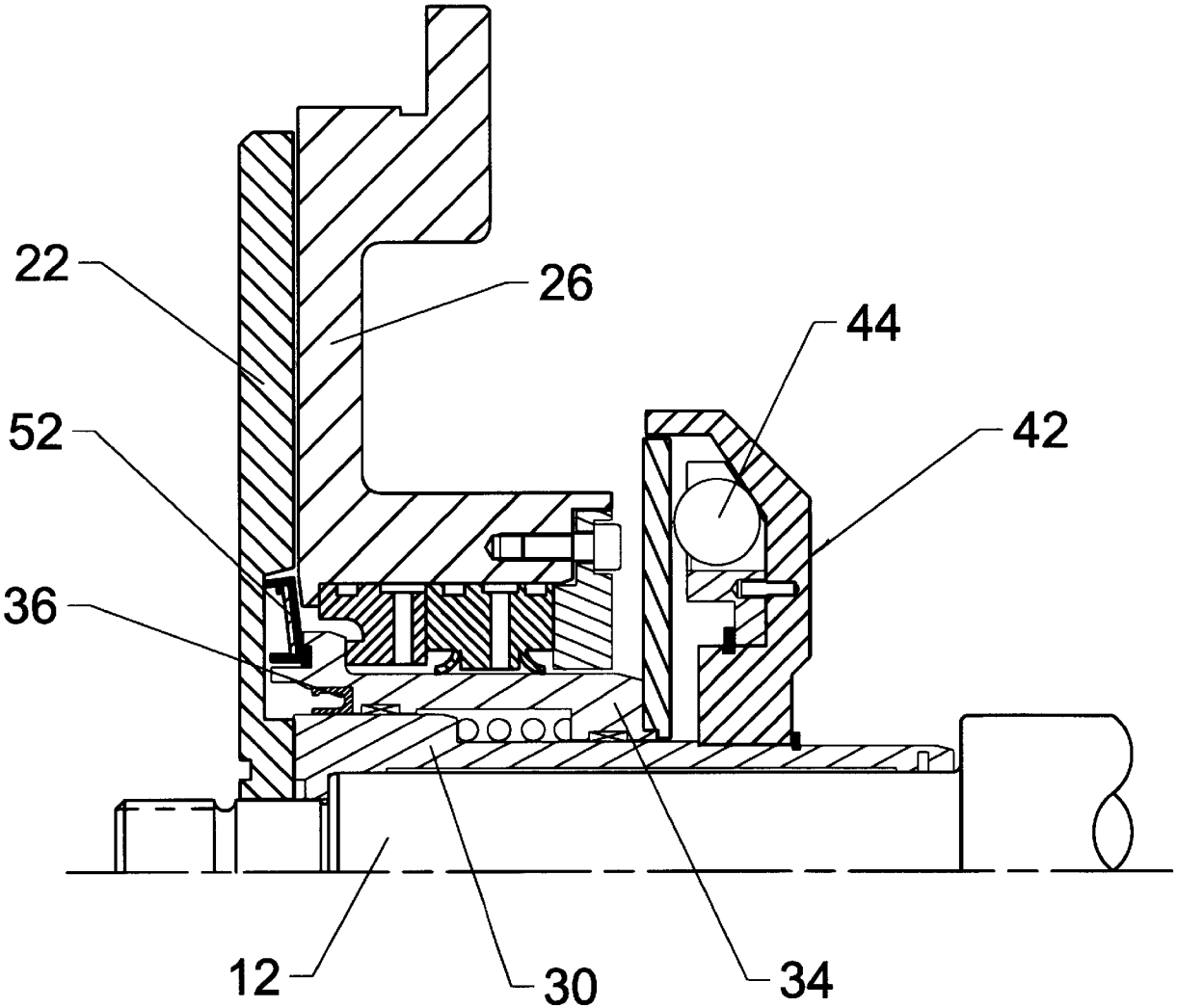
FIG. 3 is an enlarged sectional view corresponding to FIG. 2 but illustrating the pump in the non-operating position.
Figure 4:
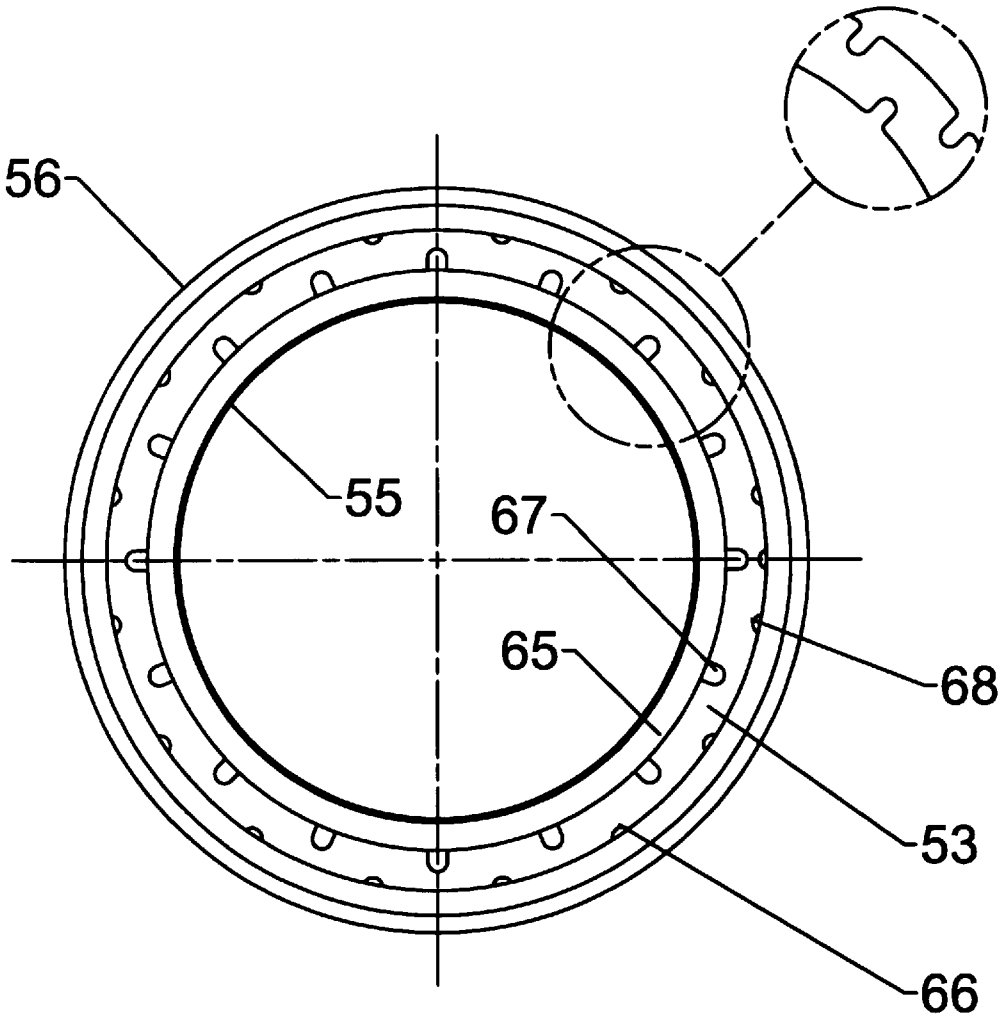
FIG. 4 is a front view in detail of the preferred form of barrier ring in accordance with the present invention.
Figure 6:
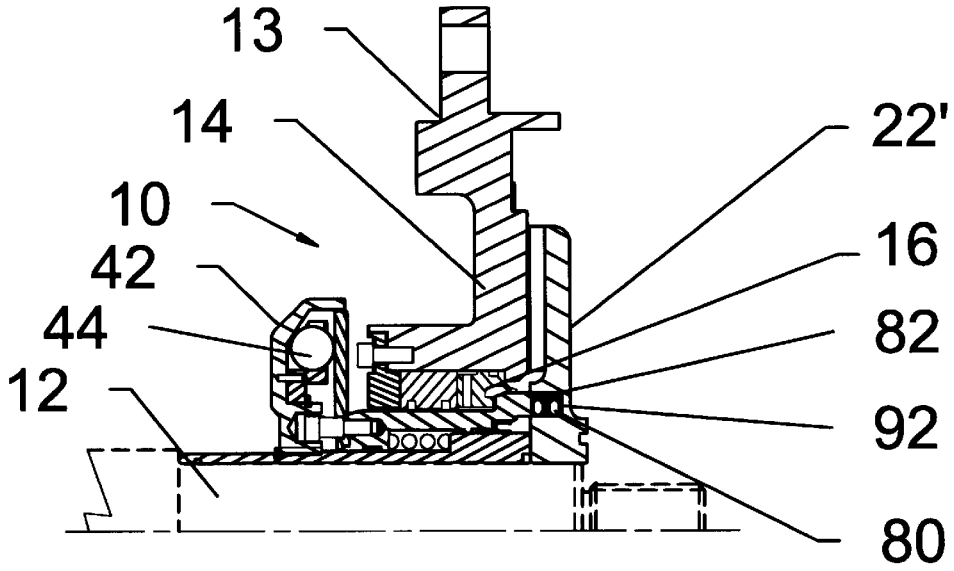
FIG. 6 is an enlarged sectional view of a modified form of barrier ring installed in a pump, the pump being shown in the non-operating position.
Figure 7:
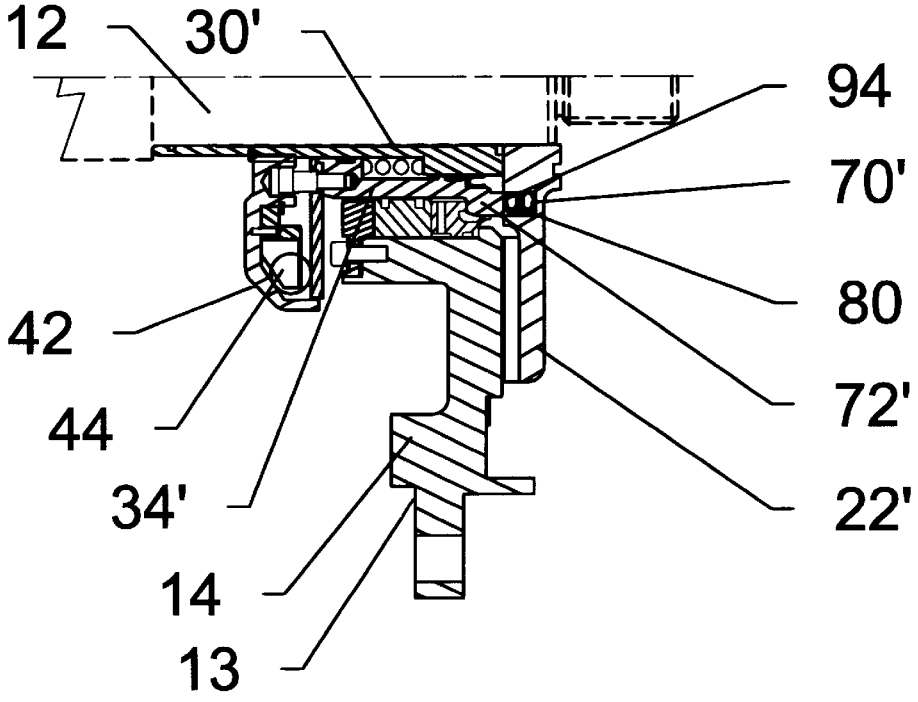
FIG. 7 is an enlarged sectional view corresponding to FIG. 6 illustrating the pump in the operating position.

Referring to FIGS. 2 and 3, a lip seal 36 is mounted in a recess formed between the hub 30 and sleeve 34 together with an O-ring 37. Seals 38 and 39 are interposed between the expeller 22 and hub 30 and between the expeller 22 and inner hub portion of the primary expeller 20, respectively. The labyrinth seal assembly 16 is mounted in the seal housing between the inner and outer walls 34 and 26 as described and a governor mechanism or driver 42 in the form of a ball bearing and race assembly has a series of circumferentially spaced balls 44 in a ball race 46 for the purpose of sliding or rolling in a radial direction as illustrated along a convergent cam surface 48 and a movable actuator wall 50. When the drive shaft 12 starts to rotate, the actuator wall is movable in a forward direction under the urging of the balls 44 along the cam portion 48 to overcome the return spring 33 and advance the actuator sleeve 34 in a forward direction. When the drive shaft stops rotating, the balls 44 will return to an inner radial disposition as illustrated in FIG. 4, and the return spring 33 will then overcome the driver to cause the actuator sleeve 34 to be urged rearwardly under the force of the return spring 33. Again, the foregoing is given by way of illustration and as a setting for the utilization of a novel form of barrier ring 52, as shown in detail in FIGS. 4 and 5 to greatly minimize if not prevent leakage of fluid past the ring 52 into the seal assembly 16 Thus, any liquid that may remain in the space between the expeller 22 and seal housing wall 26 will be effectively prevented from leaking past the barrier ring 52 into the seal assembly 16 during the critical period when the pump is turned off and the drive shaft is no longer rotating since, during this interval, the liquid and any entrained solids will no longer be driven away from the radially inner part of the expeller vanes by centrifugal force.

Figure 5:
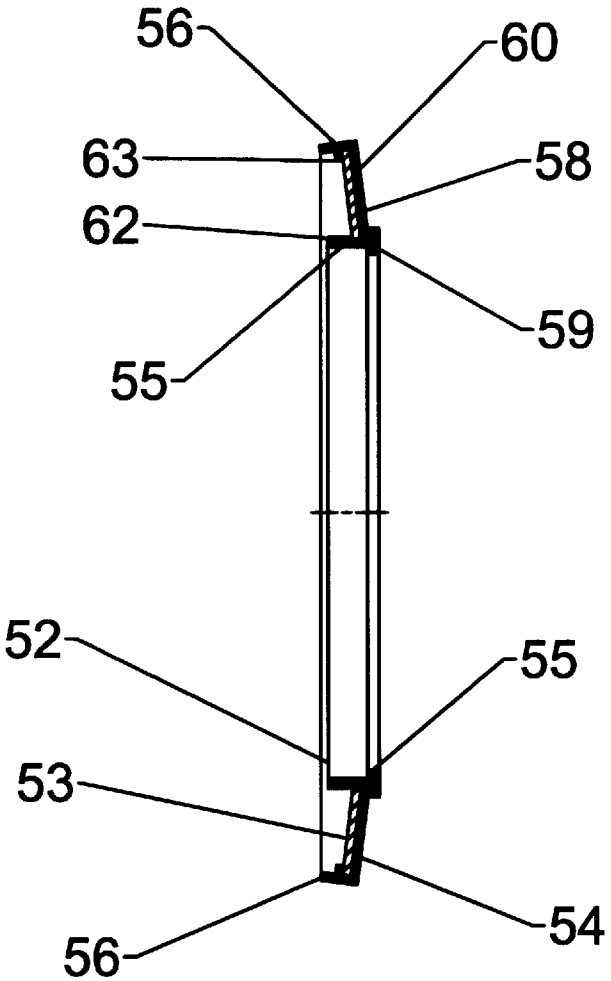
FIG. 5 is a cross-sectional view of the barrier ring illustrated in FIG. 4.

The preferred form of barrier ring 52 is broadly comprised of a spring diaphragm 53 and an outer jacket 54. As shown in FIGS. 4 and 5, the jacket 54 is of annular configuration having opposed inner and outer circumferentially extending inner and outer sealing portions 55 and 56, respectively, joined by a continuous circumferential web 58 which inclines rearwardly and radially outwardly away from a front end 59 of the sealing portion 55 into a front end surface 60 of the outer sealing portion 56. The jacket 54 is preferably composed of a plastic, rubber or rubber-like material which is chemically compatible with the liquid to be sealed, flexible enough to withstand relative movement to be hereinafter described, and soft enough to form a liquid-tight seal along both sealing portions 55 and 56. Typical materials are PTFE, modified PTFE with carbon or fiberglas, ethylene polypropylene, Viton, neoprene, AFLAS. As described, the web 58 effectively forms a closure across the front end of the barrier ring, and confronting surface portions of the inner and outer sealing portions 55 and 56 are provided with grooves 62 and 63 offset from one another in accordance with the rearward inclination of the front wall 58 and adapted to receive the spring diaphragm 53.

The diaphragm 53 is of generally frustoconical configuration having radially inner and outer edges 65 and 66 in which cutouts or generally U-shaped profiles 67 and 68 are formed, respectively, to establish the spring constant of the spring 53. The cutouts 67 and 68 are sized to be specific to each pump size in order to compensate for differences in opening and closing forces and particularly that result from the centrifugal force of the driver mechanism 42, although the cutouts 67 may be the same or different size than cutouts 68. The spring element 53 is inserted into the jacket 54 with the inner edge 65 inserted into the groove 62 and the outer edge 66 inserted into the outer groove 63. In the specific application for centrifugal pumps to be hereinafter described, a preferred composition of the spring is stainless steel, such as, Hastelloy C, 316 SS, 304 SS and Monel to provide the desired strength and corrosion resistance. Carbon steel or plastic materials are suitable for other applications.

In order to install and maintain the barrier ring 52 in proper relation to the expeller 22 and seal housing wall 26, the expeller 22 is provided with a circumferential recess or groove 70 adjacent to the hub 24 and in confronting relation to the front end of the actuator sleeve 34. For this purpose, the front end is in the form of a raised or thickened circumferential portion 72 in surrounding relation to the lip seal 36 and a forwardly projecting ring 74 which extends into the circumferential recess 70 and which effectively defines the inner boundary wall for the barrier ring 52 when inserted into the recess. The barrier ring 52 is dimensioned such that the inner sealing portion 55 is wide enough to be mounted under compression between the raised portion 72 and opposed end wall surface 75 of the recess 70 and will remain in contact with the surfaces notwithstanding axial movement of the actuator sleeve 34 in response to rearward movement of the actuator sleeve 34 under the urging of the return spring 33. Nevertheless, there may be a slight separation between the edge of the sealing portion 55 and recess wall in the respect that the conical spring element 53 will tend to urge the barrier ring in a direction following actuator sleeve movement at least along the inner sealing portion 55.

The outer sealing portion 56 is interposed between the radial wall 26 and recess 70 and will tend to bear more firmly against the wall of the recess 70 than the confronting surface of the radial wall 26 but nevertheless, under the urging of the spring 53, will remain in firm sealing engagement with the wall of the recess 70 as the inner sealing portion 55 remains in firm sealing engagement with the projecting end 72. In this relation, it is to be understood that the relaxed position of the spring is substantially as shown in FIG. 3 so that, when inserted within the recessed area 70, will be cocked only slightly away from its relaxed disposition; however, when the driver 42 is activated to start operation of the pump the resultant forward advancement of the actuator sleeve 34 will cause the spring 52 to be cocked into a more nearly radial disposition as shown in FIG. 2 and increase the sealing engagement by sealing portion 55 and spring 53 to further minimize any danger of leakage of liquid past the barrier ring 52 into the seal assembly 16. In this way, a sufficient clearance or gap is formed during operation of the pump to permit any liquid that might have leaked past the seal into the seal assembly area to return along the gap or space between the radial wall 26 and expeller 22; however, a seal is maintained against leakage into the hub area 30 and lip seal 36.

DETAILED DESCRIPTION OF MODIFIED FORM OF INVENTION

Figure 9:
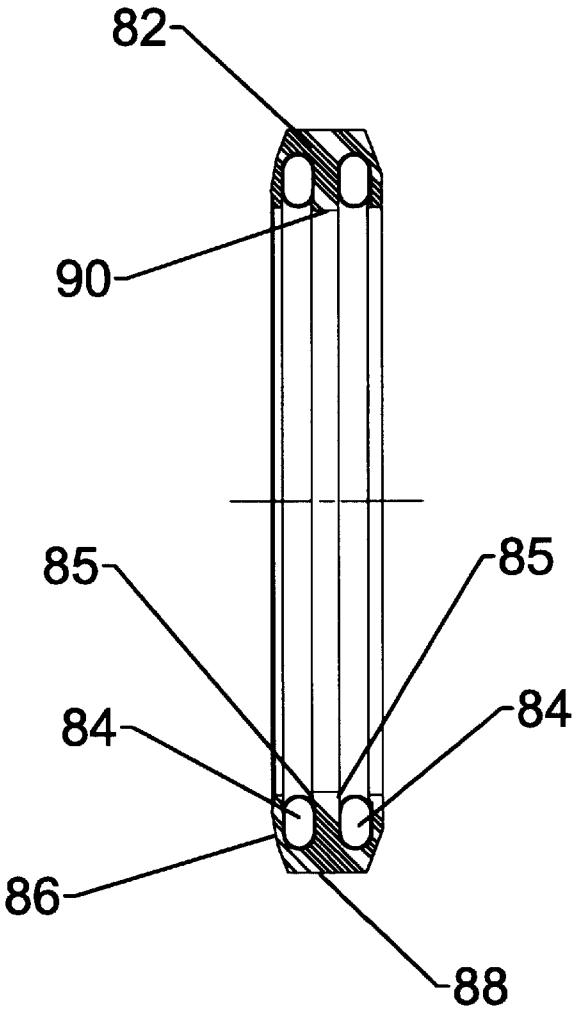
FIG. 9 is a cross-sectional view of the barrier ring shown in FIG. 8.
Figure 8:
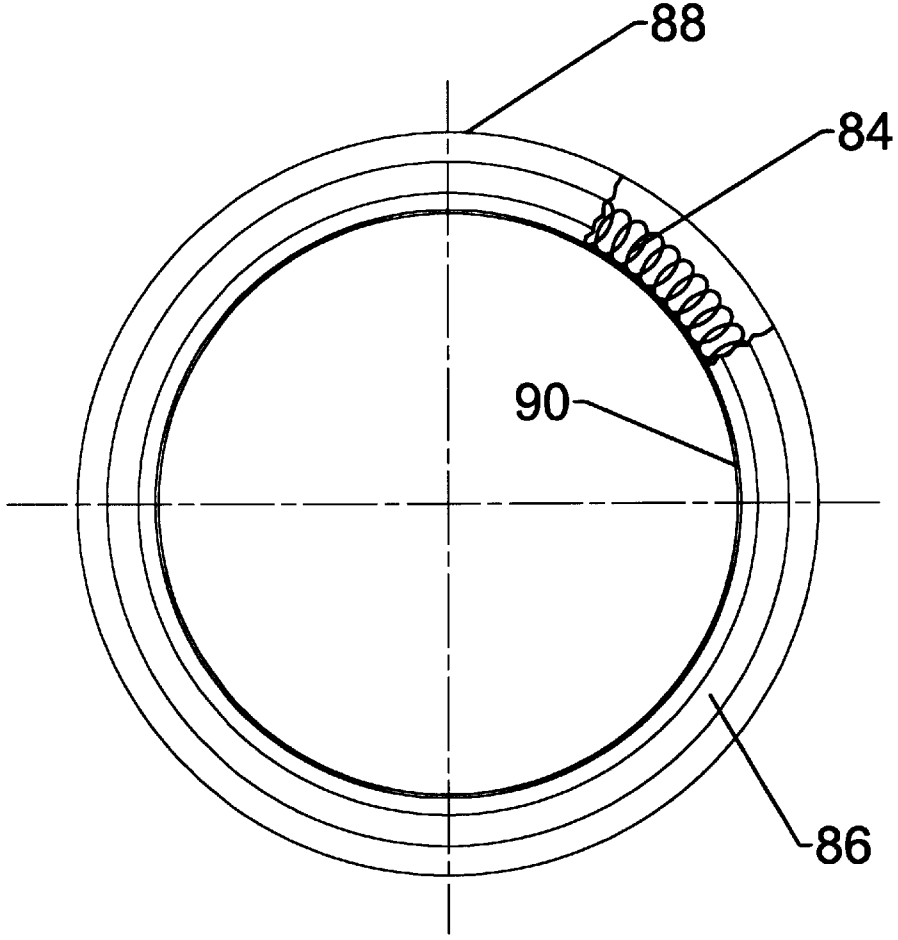
FIG. 8 is a front view of the modified form of barrier ring illustrated in FIGS. 6 and 7.

A modified form of invention is illustrated in FIGS. 6 to 9 in which like parts are correspondingly enumerated to those of FIGS. 1 to 5. Specifically, a modified form of barrier ring 80, as shown in detail in FIGS. 8 and 9 is interposed between the actuator sleeve 34' and wall of a recess 70' in the expeller 22'. The barrier ring 80, as illustrated in FIGS. 8 and 9 is broadly comprised of a jacket 82 of rubber or rubber-like material and helical spring members 84 disposed in a pair of juxtaposed grooves 85 in the interior of the jacket 82. Again, the jacket 80 is of annular configuration and tapers outwardly from opposite side walls 86 into a common flat circumferential surface or sealing portion 88. In addition, the grooves 85 are separated by a common wall 90; and, while the side walls 86 and common wall 90 are of an elastic or resilient material, are of sufficient strength to cause the spring members 84 to assume somewhat of an ellipsoid or oval-shaped configuration within the grooves 85.

The specific construction and arrangement of the barrier ring 80 is to permit snug-fitting insertion within a circumferential pocket or recess 92 in the wall of the expeller, and the actuator sleeve 34' has a forward, raised projecting part 72' which terminates in a squared end wall surface 94. The barrier ring 80 is dimensioned such that it will remain under uniform engagement with the end wall 94 of the actuator sleeve 34' and be slightly compressed when inserted into the pump in the initial assembly process and when the pump is not operating. When the actuator sleeve 34' is advanced forwardly during pump operation it will again increase the pressure on the barrier ring 80 and continue to maintain uniform but increased sealing engagement with the side wall of the ring 80.

It will be evident from the foregoing that the modified form of barrier ring is not as versatile as the preferred form and does not afford as much latitude for selective leakage of liquid past the outer sealing portion of the ring while the pump is in operation. For this reason, the preferred form of barrier ring 52 is conformable for use in other applications requiring fairly substantial travel of a sealing ring member while being capable of exerting sealing force in both positions. Although not shown, another typical application for a barrier ring 52 of the type described is for use as the centrifugal force responsive spring element, such as, the element 66, 66' shown in the patent to Whittier et al U.S. Pat. No. 4,915,579 and incorporated by reference herein.

It is therefore to be understood that while preferred and modified forms of invention are herein set forth and described, the above and other modifications and changes may be made in the construction and arrangement of parts as well as composition of materials without departing from the spirit and scope of the invention as defined by the appended claims and reasonable equivalents thereof.

I claim:

1. In a centrifugal pump having a seal housing for a stationary seal in outer spaced surrounding relation to a drive shaft, an impeller and an expeller mounted on said drive shaft forwardly of said seal housing wherein said expeller is operative to resist liquid flow into said seal housing when said drive shaft is rotated at a predetermined rate of speed, the improvement comprising:

an annular barrier seal member interposed in a gap between said expeller and said seal housing, said gap changing in width in response to axial movement of said seal housing toward and away from said expeller when said drive shaft is being rotated, said seal member including an outer jacket of a flexible material, an annular spring of generally conical configuration secured in said jacket, said seal member extending at an acute angle between confronting surfaces of said expeller and said housing with opposite edges of said jacket maintaining sealing engagement with said expeller and said housing notwithstanding variations in the width of said gap.

2. In a pump according to claim 1, wherein said opposite edges are disposed along opposite inner and outer radial edges of said jacket.

3. In a pump according to claim 2 wherein a groove extends between said opposite edges.

4. In a pump according to claim 3 wherein an entrance to said groove is provided along one side of said jacket, said entrance and said groove extending continuously around the full circumference of said jacket.

5. In a pump according to claim 1 wherein said spring is composed of metal in the form of an endless band of frustoconical configuration.

6. In a pump according to claim 5 wherein cutouts are formed in said band to regulate the spring force thereof.

7. In a pump according to claim 6 wherein said cutouts are formed in opposite inner and outer radial edges of said band.

8. In a pump according to claim 6 wherein said cutouts are of generally U-shaped configuration and are arranged in staggered relation to one another.

9. In a pump, a seal member interposed between confronting surface portions which undergo relative axial movement to vary the width of a gap between said portions, said seal member having an outer jacket of flexible material and an annular spring member inserted in a groove in said jacket wherein mounting of said seal member under compression between said confronting surface portions will maintain liquid-tight sealing engagement with said confronting surface portions notwithstanding variations in the width of said gap.

10. In a pump according to claim 9 wherein said jacket is disposed in a groove in one of said portions and projects into sealing engagement with the other of said portions.

11. In a pump according to claim 10 wherein said spring is an endless helical spring inserted in a circumferentially extending groove in said jacket.

12. In a pump according to claim 11 wherein a pair of said endless helical springs extend in closely spaced, juxtaposed relation to one another in a pair of said grooves in said jacket.

13. In a pump according to claim 9 wherein said jacket has sealing portions along opposite inner and outer radial edges thereof, and a groove extending between said sealing portions continuously around the full circumference of said jacket.

14. In a pump according to claim 13 wherein said spring is in the form of an endless band of generally frustoconical configuration inserted in said jacket.

15. In a centrifugal pump wherein a drive shaft is surrounded by a casing, a seal housing disposed in said casing in surrounding relation to a portion of said drive shaft, an impeller for discharging liquid introduced through an inlet in said casing and an expeller between said impeller and said seal housing to resist liquid flow past said expeller into said seal housing when said pump is in operation and wherein drive means is provided for imparting forward axial movement to an actuator sleeve in response to rotation of said drive shaft and a lip seal being interposed between said actuator sleeve and said drive shaft, the improvement comprising:

an annular seal member interposed in a gap between said expeller and said seal housing, said gap changing in width in response to axial movement of said seal housing toward and away from said expeller, said seal member including an outer jacket having opposed sealing edges, an annular spring of generally conical configuration inserted into a groove in said jacket, said seal member extending at an acute angle between confronting surfaces of said expeller in said housing with said sealing edges maintaining sealing engagement with said expeller and said housing notwithstanding variations in the width of said gap.

16. In a pump according to claim 15, wherein said opposite edges are disposed along opposite inner and outer radial edges of said jacket, an entrance to said groove being provided along one side of said jacket, said entrance and said groove extending continuously around the full circumference of said jacket.

17. In a pump according to claim 15 wherein said spring is composed of metal in the form of an endless band of frustoconical configuration, and cutouts are formed in said band to regulate the spring force thereof.

18. In a pump according to claim 17 wherein said cutouts are formed in opposite inner and outer radial edges of said band.

19. In a pump according to claim 18 wherein said cutouts are of generally U-shaped configuration, said cutouts in said inner radial edge being deeper than those in said outer edge.

20. In a centrifugal pump wherein a drive shaft is surrounded by a casing, a seal housing disposed in said casing in surrounding relation to a portion of said drive shaft, an impeller for discharging liquid introduced through an inlet in said casing and an expeller between said impeller and said seal housing to resist liquid flow past said expeller into said seal housing when said pump is in operation and wherein drive means is provided for imparting forward axial movement to an actuator sleeve in response to rotation of said drive shaft, a lip seal being interposed between said actuator sleeve and said drive shaft, the improvement comprising:

a dynamic seal member interposed between radial wall portions of said expeller and said seal housing which undergo relative axial movement to vary the width of a gap between said wall portions, said seal member having an outer jacket of flexible material and an annular spring member having inner and outer radial edges inserted in offset grooves in said jacket wherein mounting of said seal member under compression between confronting surfaces of said wall portions will maintain liquid-tight sealing engagement with said confronting surfaces notwithstanding variations in the width of said gap.

21. In a pump according to claim 20, wherein said spring member has opposite edges disposed along opposite inner and outer radial edges of said jacket.

22. In a pump according to claim 21 wherein said grooves extend between said opposite edges.

23. In a pump according to claim 22 wherein an entrance to said groove is provided along one side of said jacket, said entrance and said grooves extending continuously around the full circumference of said jacket.

24. In a pump according to claim 20 wherein said spring is composed of metal in the form of an endless band of frustoconical configuration, and cutouts are formed in said band to regulate the spring force thereof.

25. In a pump according to claim 24 wherein said cutouts are formed in opposite inner and outer radial edges of said band.

* * * * *

UNITED STATES PATENT AND TRADEMARK OFFICE

CERTIFICATE OF CORRECTION

PATENT NO. : 6,224,322 B1
DATED : May 1, 2001
INVENTOR(S) : Calboreanu, Gabriela E.

It is certified that error appears in the above-identified patent and that said Letters Patent is hereby corrected as shown below:

Column 3,
Line 58, cancel "FIG. 4," and substitute -- FIG. 3, --

Column 8,
Line 36, cancel "to said groove" and substitute -- to said grooves --

Signed and Sealed this

Thirteenth Day of August, 2002

*Attest:*

*Attesting Officer*

JAMES E. ROGAN
*Director of the United States Patent and Trademark Office*